US007154818B2

(12) United States Patent
Liu

(10) Patent No.: US 7,154,818 B2
(45) Date of Patent: Dec. 26, 2006

(54) RADIO CONTROLLED CLOCK MOVEMENT CONTROL SYSTEM

(75) Inventor: Tsai-Te Liu, Taoyuan (TW)

(73) Assignee: Ele Gancy Tleleancy Co., Ltd., Taoyuan (TW)

( * ) Notice: Subject to any disclaimer, the term of this patent is extended or adjusted under 35 U.S.C. 154(b) by 296 days.

(21) Appl. No.: 10/964,347

(22) Filed: Oct. 12, 2004

(65) Prior Publication Data

US 2006/0077764 A1 Apr. 13, 2006

(51) Int. Cl.
*G04C 3/00* (2006.01)
*G04C 9/00* (2006.01)

(52) U.S. Cl. ..... 368/220; 368/47; 368/79; 368/187

(58) Field of Classification Search ..... 368/79, 368/80, 220, 239, 187, 47
See application file for complete search history.

(56) References Cited

U.S. PATENT DOCUMENTS 4,645,357 A * 2/1987 Allgaier et al. ..... 368/187
5,734,474 A * 3/1998 Haecker et al. ..... 356/623
5,930,205 A * 7/1999 Baba et al. ..... 368/80
5,989,644 A * 11/1999 Williams ..... 427/424
6,038,523 A * 3/2000 Akahane et al. ..... 702/150
6,307,815 B1 * 10/2001 Polosky et al. ..... 368/220
6,731,571 B1 * 5/2004 Yiu ..... 368/79
6,804,173 B1 * 10/2004 Yiu ..... 368/220
6,807,128 B1 * 10/2004 Yiu ..... 368/220

* cited by examiner

*Primary Examiner*—Vit Miska
*Assistant Examiner*—Jeanne-Marguerite Goodwin

(57) ABSTRACT

Disclosed is a radio controlled clock movement control system, including two stepper motors, two gearings, and a photo electronic control unit. The two stepper motors are operated independently each one driving a gearing, where the first gearing contains a second wheel, and the second gearing contains an hour wheel and a minute wheel. The photo electronic control unit contains a first photo detector, a second photo detector, and a light source. Multiple through holes are formed in succession over one sector near the rim of the second and minute wheels, which are moved in the direction of rotation over the photo detectors that undertakes to check the minute and second wheels for the zero alignment. Therefore, a radio controlled clock having the present clock movement control system can be self reset in a fast manner.

6 Claims, 8 Drawing Sheets

RADIO CONTROLLED CLOCK MOVEMENT CONTROL SYSTEM

BACKGROUND OF THE INVENTION

1. Field of the Invention

The present invention relates to a clock movement control system used on radio controlled clocks, and in particular to a new radio controlled clock movement control system that enables the synchronized adjustment of the hour, minute, and second wheels with high efficiency and self reset in a fast manner.

2. The Related Art

In conventional clocks, a mechanical movement is used to drive the hour, minute, and second wheels. A radio controlled clock, however, makes use of wireless transmission technology incorporating such as an RF signal receiving element, a signal processing element, and an automatic time correction element in the movement control circuit, so that the radio controlled clock can receive radio wave signals from a ground transmitter that gets the time from a standard time generator. Once the radio controlled clock has decoded the signals through the RF signal receiver, the clock uses that time information to synchronize the hour, minute and second hands in its own clock, so that the same clock time will appear on all radio controlled clocks receiving the same radio signals. Also, another function of the radio controlled clock is that it can be self-reset down to the seconds every hour on the hour, so there will be no time discrepancy at all on any one of the radio controlled clocks.

Referring to FIG. 1, the typical architecture of a radio controlled clock includes a micro antenna 11, RF signal receiver 12, a microcontroller 13, and a clock movement module 14. The RF signal receiver 12 receives the time information through the RF receiver 12. After signal decoding, the signals are passed to the microcontroller 13, which works through the clock movement module 14 to synchronize the hour, minute and second wheels. When the radio controlled clock is activated, the hour, minute, and second wheels are first self-reset, and then the microcontroller 13 receives the standard time information, and synchronizes the movement of the hour, minute, and second wheels. The clock movement module 14 employs a photoelectronic control unit to adjust the hour, minute, and second wheels when a self-resetting is initiated.

Conventionally, the radio controlled clock movement module only has a single motor to drive the second wheel into rotation, which, through a linking gear, in turn drives the minute wheel, and, the later, further through another linking gear, causes the hour wheel to rotate in succession. If a time checking is initiated every hour on the hour, for example at one o'clock, the hour, minute, and second wheels first have to be self-reset. A photo-electronic control unit is used to determine whether the hour, minute, and second wheels are all zero reset. In the worst case scenario, the second wheel has to rotate 660 cycles to bring the hour, minute and second wheels back to respective zero positions, which is a time-consuming process. Therefore, the new generation of clock movement uses two motors and a photoelectronic control unit in the clock movement module, which performs the self-reset in two sections independent of each other, where the first motor to control the rotation of the second wheel, and the second motor is to control the rotation of the hour/minute wheels. This two-motor clock movement control has out performed the one-motor control model, but the time required for self-reset could be further improved if the operation of the motor is optimized.

SUMMARY OF THE INVENTION

The primary objective of the present invention is to provide a radio controlled clock movement control system that enables the synchronized adjustment of the hour, minute, and second wheels with high efficiency and the self-reset in a fast manner.

The secondary objective of the invention is to provide a radio controlled clock movement control system that is able to produce precision adjustment of the hour, minute, and second wheels, and to prevent vibration caused gearing alignment problems during a zero alignment process.

The proposed clock movement control system is composed of two stepper motors, two gearings, and a photo electronic control unit. The two stepper motors are operated independently, each driving one gearing. The first gearing has at least two reduction gears and a second wheel, and the second gearing includes a minute wheel, an hour wheel, and at least one reduction gear. Multiple through holes are formed in succession over a sector near the rim of the wheel, which are moved consecutively in the direction of the rotation over the alignment position. In the second gearing, the minute wheel and the hour wheel partially overlapping rotate with different speeds, where the minute wheel has multiple through holes formed in succession over a sector near the rim of the wheel, and the hour wheel has one through hole formed at a position under which all through holes on the minute wheel are to move in the direction of rotation, and the diameter of the through hole on the hour wheel shall be greater than or equal to the diameter of a through hole on the minute wheel. One of the two photo detectors in the photoelectronic control unit is installed at a position over which all through holes on the minute wheel are to pass in the direction of rotation, and another one is installed at another position over which all through holes on the second wheels are to pass in the direction of rotation.

The photo electronic control unit includes a light source, a first photo detector, and a second photo detector. These photo detectors are used to determine whether the through hole of the second or minute wheel is aligned over the photo detector, i.e. the alignment position, and then a high voltage is output by the photo detector to the clock movement module, otherwise a low voltage is normally maintained over the signal line, thus serving as a toggle switch.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
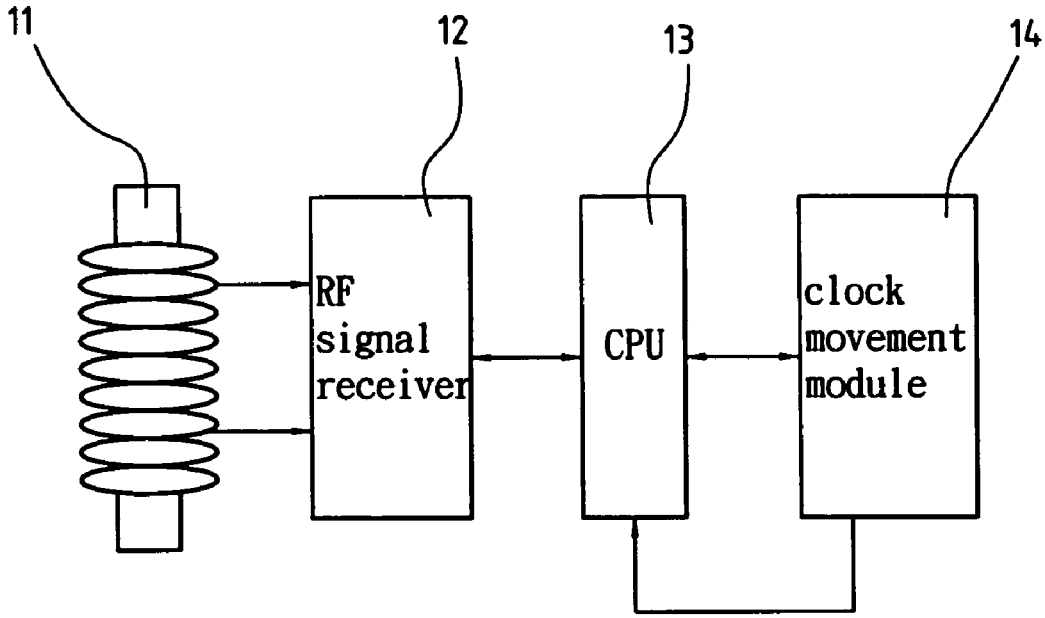
FIG. 1 is a block diagram of the overall architecture of the radio controlled clock in accordance with the present invention.
Figure 2:
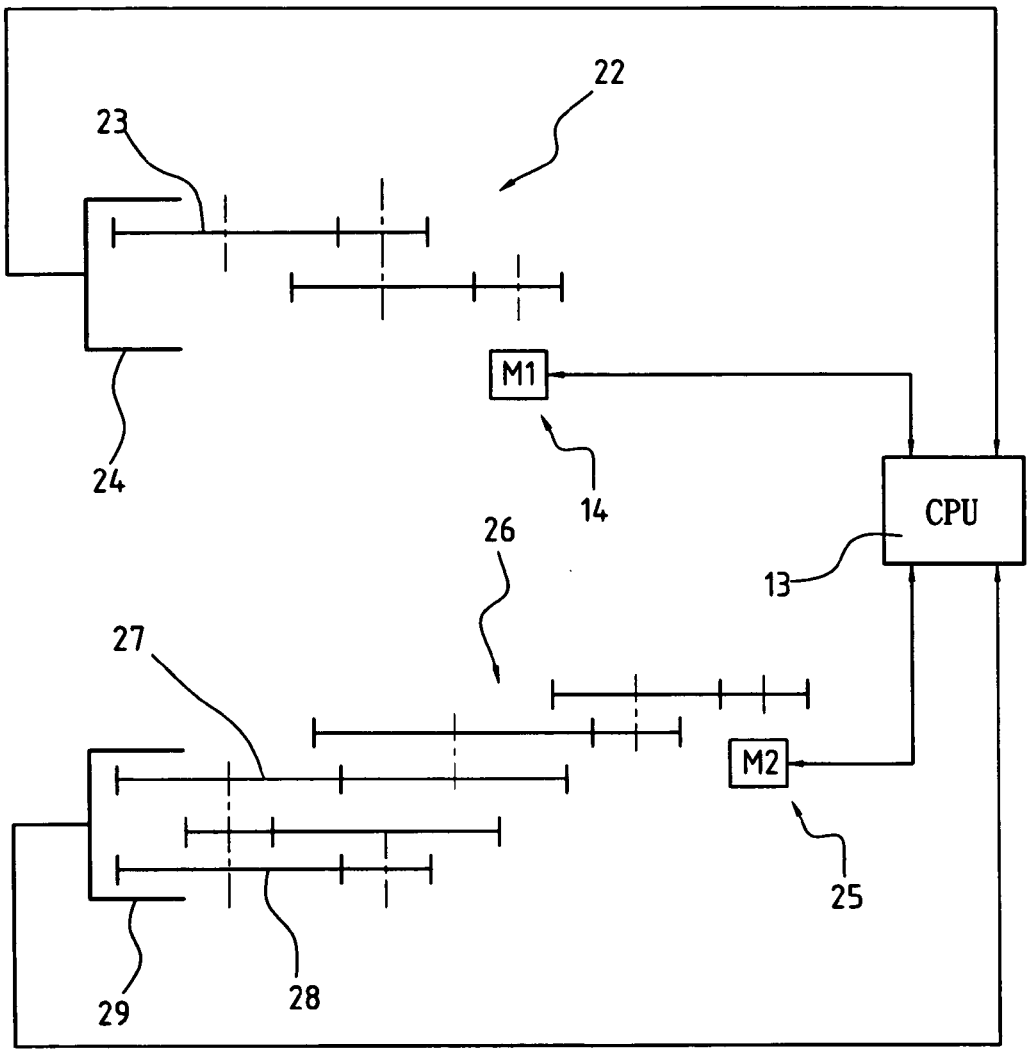
FIG. 2 is a structural diagram of the clock movement module in accordance with the present invention.

Referring to FIG. 2, the architecture of the clock movement module on a radio controlled clock consists of two stepper motors, two gearings, and a photo electronic control unit. A microcontroller 13 is used in the clock movement module to coordinate the action of the first stepper motor 21 and second stepper motor 25, which are operated independently. The first gearing 22 contains a second wheel 23 driven by the first stepper motor 21, and the second gearing 26 contains an hour wheel 27 and a minute wheel 28 driven by the second stepper motor 25.

Once the clock movement module is activated, the second wheel 23 in the first gearing 22 starts to rotate, and the minute wheel 27 in the second gearing 26 is also driven into rotation, through which the hour wheel 28 is driven into action, so that the hour, minute and second wheels are able to rotate synchronously with different speeds.

Figure 3A:
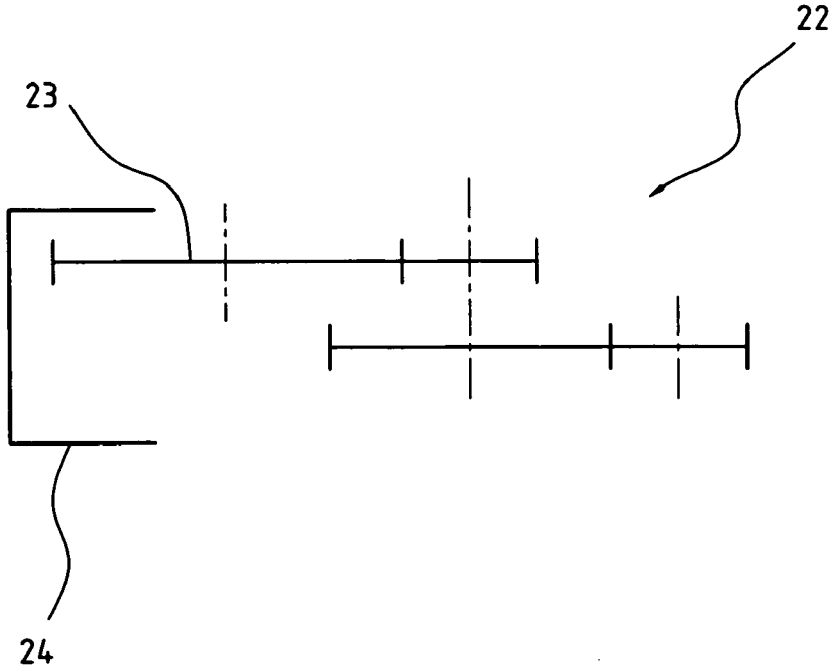
FIG. 3A is a sectional diagram of the structure of the first photo detector and the second wheel.
Figure 3B:
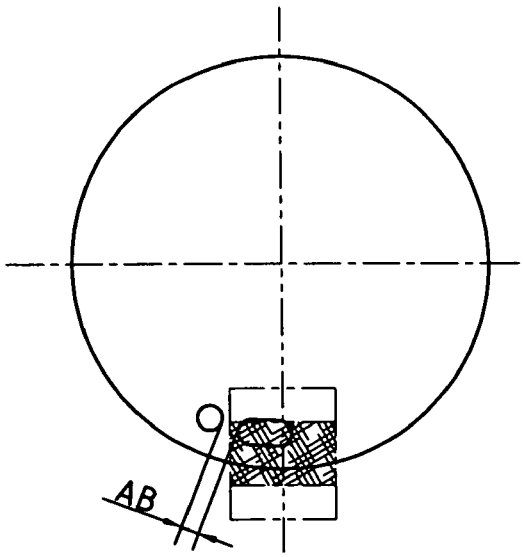
FIG. 3B is a top view shows how the first photo detector scans the surface of the rotating second wheel for through holes.
Figure 4A:
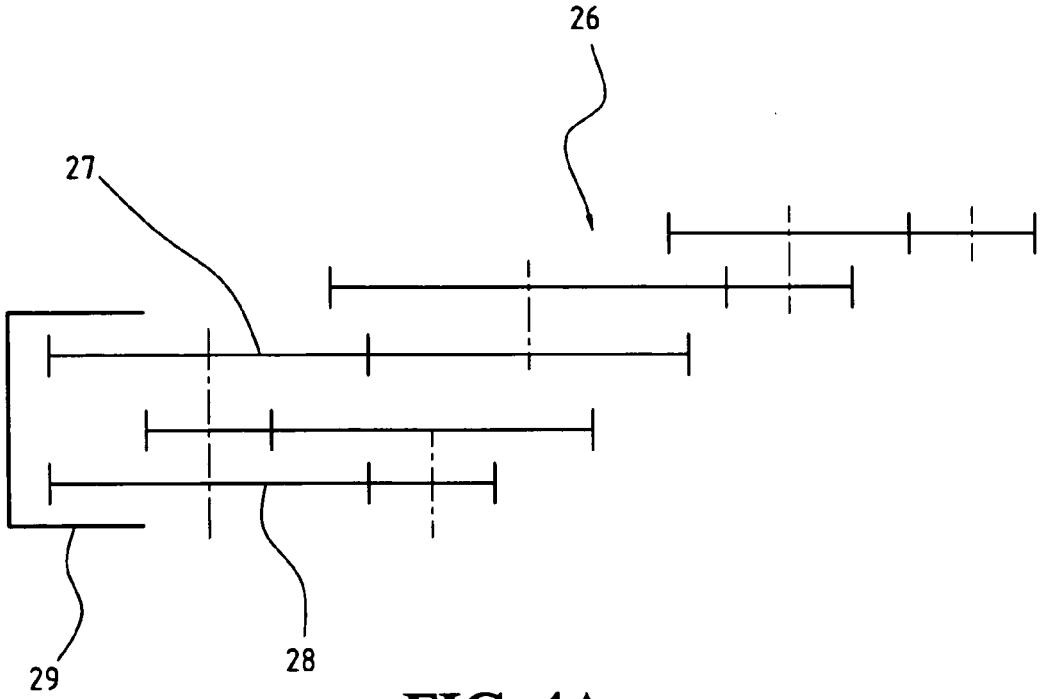
FIG. 4A is a sectional diagram of the structure of the second photo detector and the minute wheel.
Figure 4B:
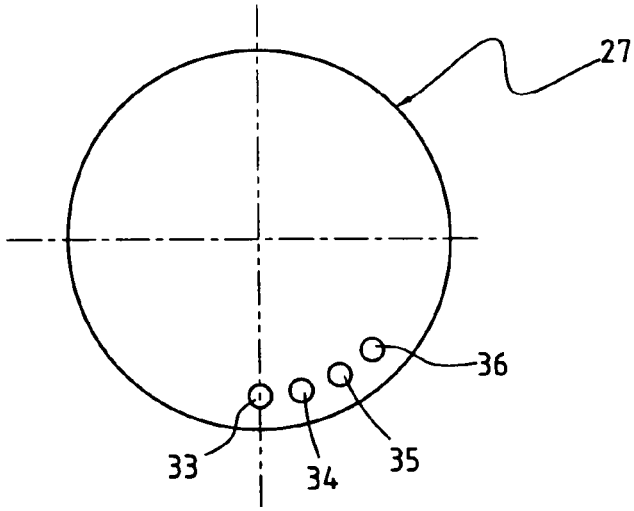
FIG. 4B is a top view showing the arrangement of through holes on one sector of the minute wheel.
Figure 4C:
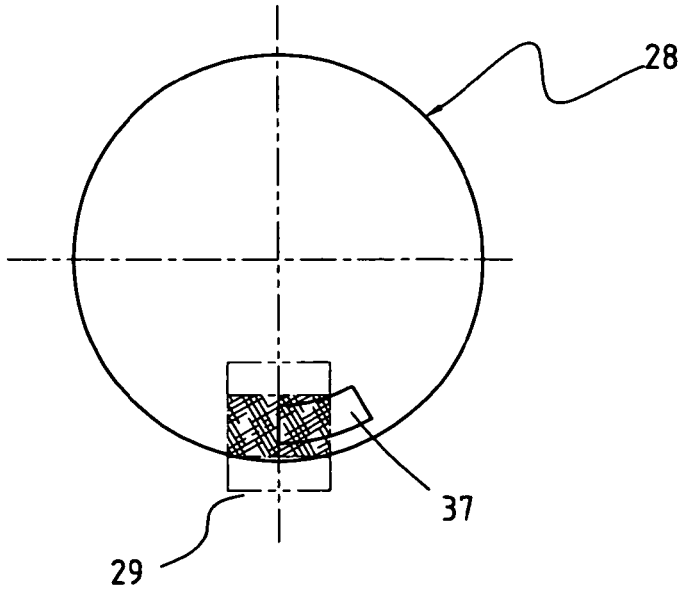
FIG. 4C is a top view shows how the second photo detector scans the surface of the rotating minute wheel for through holes.

Referring to FIGS. 3A and 3B, two through holes 31, 32 are formed over a sector near the rim of the second wheel 23, keeping a distance AB in between the two through holes, which are moved consecutively in the direction of the rotation over a photo detector 24. Referring to FIGS. 4A–4C, four through holes 33–36 are formed in succession over one sector near the rim of the minute wheel 27, and the hour wheel 28 has one through hole 37 formed at one position under which all through holes of the minute wheel 27 are to pass in the direction of rotation, and the diameter of the through hole 37 of the hour wheel 28 is greater than or equal to that of a through hole (33, 34, 35, 36) on the minute wheel 27.

The photo electronic control unit is formed by a light source and two photo detectors (24, 29), which serve as two toggle switches. The first photo detector 24, as shown in FIG. 3A, is installed on one side to coincide with a through hole (31, 32) when the second wheel 23 moves in the direction of rotation over the photo detector 24. The first photo detector 24 is used to determine whether one of the through holes (31, 32) is aligned over the first photo detector 24, i.e. the alignment position of the second wheel 23, so that a high voltage signal is output by the first photo detector 24. The second photo detector 29, as shown in FIG. 4A, is installed on the same side to coincide with a through hole (33–36) when the minute wheel 27 moves in the direction of rotation over the second photo detector 29. When the through hole 37 on the hour wheel 28, one of the through holes (33–36) on the minute wheel 27, the light source, and the second photo detector 29 are all on a straight line, that means the minute wheel 27 and hour wheel 28 are simultaneously aligned over the second photo detector 29, so a high voltage signal is generated.

When a self-reset is requested, as shown in FIGS. 3A and 3B, the second wheel 23 starts to rotate so that through holes (31, 32) move consecutively into the detection range of the photo detector 24. When the first photo detector 24 picks up a light signal, that means one of the two through holes (31, 32) are moved right over the first photo detector 24 allowing light signals from the light source to pass through to the first photo detector 24, so a high voltage is output, otherwise lower voltage is normally maintained over the signal line.

Figure 5A:
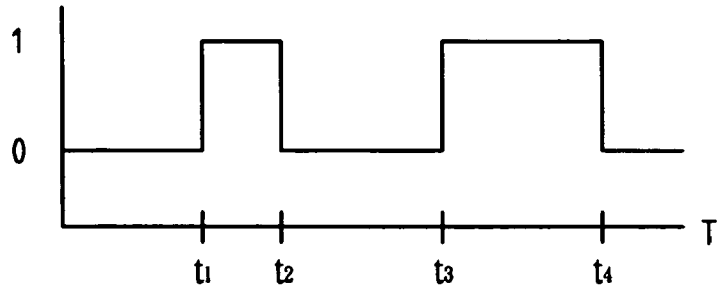
FIG. 5A is a timing diagram of signals output by the first photo detector during the zero alignment of the second wheel.

Referring to FIG. 5A, before the point t1, only low voltage appears over the signal line, but when through hole 31 of the second wheel 23 moves in over the first photo detector 24, which picks up the light signals passing through the through hole 31, so a high voltage signal, the first impulse, is output by the first photo detector 24 in the period t1–t2. The second wheel 23 continues to rotate, and then the gap AB between the two through holes covers up the photo detector 24. The light beam is again shut off, so the first photo detector 24 cannot detect any light signals during this period, and a low voltage is output in the period t2–t3. Thereafter, through hole 32 moves in over the photo detector 24, and a high voltage signal, the second impulse, is generated again in the period t3–t4. At this point, the second wheel is precisely aligned at zero position. Later when the through hole 32 moves out, the output of the first photo detector 24 returns to low voltage level again.

Figure 4D:
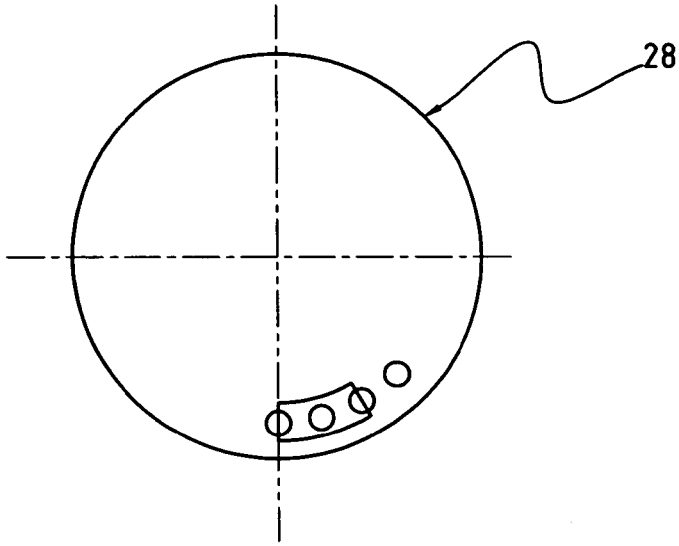
FIG. 4D is a top view showing the coincidence of a through hole of the minute wheel and the alignment position.
Figure 5B:
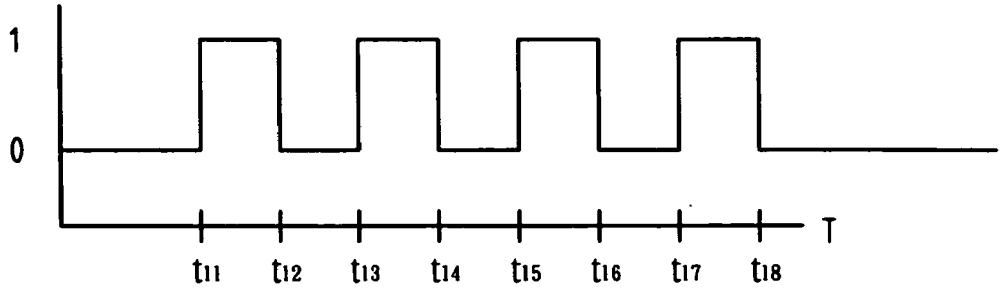
FIG. 5B is a timing diagram of the signals output by the second photo detector during the zero alignment of the minute wheel.

Referring to FIGS. 4A–4C, the hour wheel 27 and the minute wheel 28 are set to rotate with different speed. When through hole 37 of the hour wheel 28 first moves in over the photo detector 29, the minute wheel 27 continues to rotate. When through hole 33, through hole 37, the light source, and the second photo detector 29 are all on a straight line, as shown in FIG. 4D, light signals are able to penetrate two through holes 33, 37 at the same time, so that the second photo detector 29 picks up the light and produces a high voltage signal, first impulse, in the period t11–t12 as shown in FIG. 5B. Later, the minute wheel 28 continues to rotate, so the through hole 37 is shut off, and the second photo detector 29 unable to detect any light signals outputs a low voltage in the period t12–t13. Still later, when through hole 34 coincides with through hole 37, the photo detector 29 again detects light signals and generates a second impulse in the period t13–t14. Using the same operating principles, four impulses are generated in an operation cycle, as given in the present example, to allow the hour wheel and the minute wheels to be zero aligned, thus a self-resetting is completed at this point.

On the other hand, the second wheel 23 is normally driven by the first stepper motor 21 in high speed, before the point t2, as shown in FIG. 5A. When the microcontroller 13 receives the first impulse, the first stepper motor 21 is stepped down to low speed from the point t3. Once the second impulse is detected over the signal line, the first stepper motor 21 is stopped in the period t3–t4, which means the second through hole 32 of the second wheel 23 is precisely over the alignment position of the second wheel 23.

The minute wheel 28 is normally driven by the second stepper motor 25 in high speed before the point t12, as shown in FIG. 5B. When the microcontroller 13 detects the presence of the first impulse, the second stepper motor 25 is stepped down to low speed from the point t12. Once the fourth impulse is detected, the second stepper motor 25 is stopped in the period t17–t18, which means the second through hole 34 of the minute wheel 27 is precisely over the first alignment position of the minute wheel 27. It shall be noted that the motor control rests in the hands of the microcontroller 13, which is programmed to stop the motor when the impulse count reaches four, as in this example, but it could be set otherwise if multiple alignment positions are used.

These two stepper motors are equipped with a two-speed control. In the normal condition, a stepper motor is operated in high speed before the first through hole is encountered by a photo detector. Thereafter, the stepper motor is stepped down to low speed in preparation for the zero alignment. Finally, the stepper motor is stopped precisely over the zero alignment position. Therefore, through the motor speed control of the microcontroller 13, the operation of the two stepper motors (21, 25) can be optimized to attain higher efficiency in the synchronized adjustment of the hour, minute, and second wheels. Also, the use of such motor speed control can prevent vibration caused gearing alignment problems.

Figure 6A:
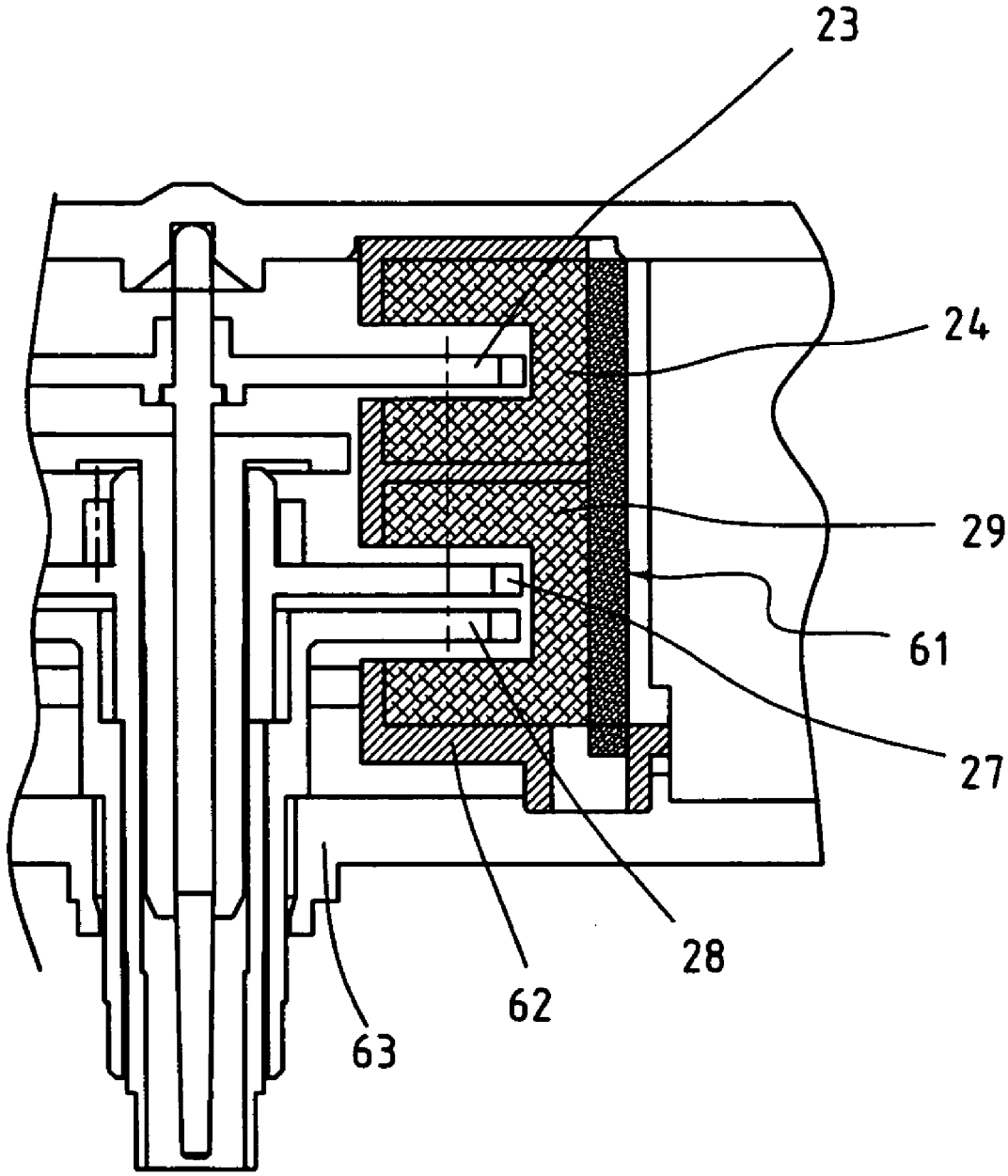
FIG. 6A is a sectional diagram of the structure of a clock movement module in accordance with the invention.
Figure 6B:
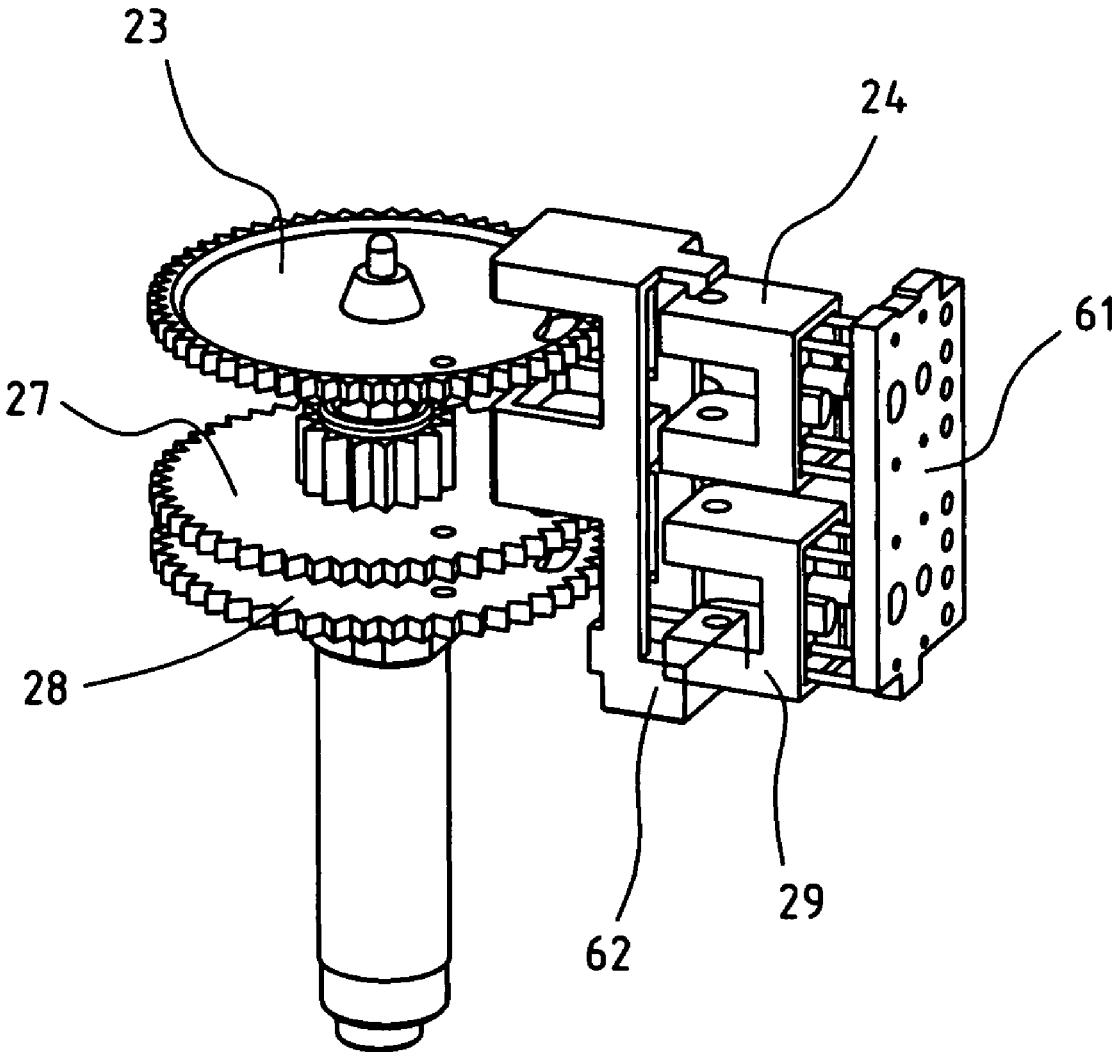
FIG. 6B is an exploded diagram of the clock movement module previously shown in FIG. 6A.

When assembling the clock movement module in a radio controlled clock, a mounting bracket 62 is used to facilitate the installation of the first and second photo detectors as shown in FIG. 6A. The first photo detector 24 and the second photo detector 29 are respectively connected to the control circuit and fixed at appropriate locations on the mounting bracket 62. The second wheel 23, the minute wheel 27 and hour wheel 28 are respectively slipped over a common shaft, so that through holes on the second wheel 23 and the minute wheel 27 can be rapidly adjusted in a zero alignment. The clock movement module is finally mounted on the lower case 63 of the radio controlled clock. Referring to FIG. 6B, the first photo detector 24 and second detector 29 can also be hard wired to the internal circuit inside the radio controlled clock.

The present invention is characterized in that the use of two independent stepper motors is able to improve the synchronized adjustment of the hour, minute and second wheels with high efficiency; and each stepper motor is built-in with a two-speed control to optimize the motor operation, so that the self-resetting can be finished in a fast manner and vibration caused gearing alignment problems can be minimized.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A radio controlled clock movement control system, comprising:

a first stepper motor;

a second stepper; wherein the first and second stepper motors are operated independently;

a first gearing containing a second wheel which is driven by the first stepper motor, wherein the second wheel has two through holes formed in succession over one sector near the rim of the wheel;

a second gearing containing a minute wheel and an hour wheel, partially overlapping each other and rotating with different speeds, which are driven by the second stepper motor, wherein the minute wheel has four through holes formed in succession over one sector near the rim of the wheel, and the hour wheel has one through hole on the same side as the through holes on the minute wheel, and the diameter of the through hole on the hour wheel is greater than or equal to a through holes on the minute wheel;

a first photo detector being installed on one side to detect through holes on the second wheel, so that when one of the through holes of the second wheel is aligned over the first photo detector, a high voltage signal is output, otherwise a low voltage is normally maintained over the signal line; and a second photo detector being installed on one side to detect through holes on the minute and hour wheels, so that when a through hole of the hour wheel and one of the through holes of the minute wheel are aligned over the second photo detector, a high voltage signal is output, otherwise al low voltage is normally maintained over the signal line.

2. The radio controlled clock movement control system as claimed in claim 1, wherein the two through holes being formed in succession over one sector near the rim of the second wheel shall be passed consecutively in the direction of the rotation over the first photo detector during the zero alignment process; and the four through holes being formed in succession over one sector near the rim of the minute wheel shall also be passed consecutively in the direction of the rotation over the second photo detector during the zero alignment process.

3. The radio controlled clock movement control system as claimed in claim 1 further comprising a mounting bracket that allows the first photo detector and the second photo detector to be attached thereon.

4. The radio controlled clock movement control system as claimed in claim 3, wherein the first and the second photo detectors are electrically connected to a control circuit by a soldering process.

5. The radio controlled clock movement control system as claimed in claim 4, wherein the control circuit used in the moving control system is actually a printed circuit board.

6. The radio controlled clock movement control system as claimed in claim 3, wherein the first and second photo detectors are hard wired to an internal control circuit in the radio controlled clock.

* * * * *